US009044943B2

(12) United States Patent
Chang et al.

(10) Patent No.: US 9,044,943 B2
(45) Date of Patent: Jun. 2, 2015

(54) INKJET PRINTHEAD INCORPORATING OLEOPHOBIC MEMBRANE

(71) Applicant: Palo Alto Research Center Incorporated, Palo Alto, CA (US)

(72) Inventors: Norine Chang, Menlo Park, CA (US); David Matthew Johnson, San Francisco, CA (US); Scott J. Limb, Palo Alto, CA (US); John S. Paschkewitz, San Carlos, CA (US); Eric J. Shrader, Belmont, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 120 days.

(21) Appl. No.: 13/856,427

(22) Filed: Apr. 3, 2013

(65) Prior Publication Data

US 2014/0300668 A1 Oct. 9, 2014

(51) Int. Cl.

| | |
|---|---|
| ***B41J 2/135*** | (2006.01) |
| ***B41J 2/14*** | (2006.01) |
| ***B41J 2/16*** | (2006.01) |

(52) U.S. Cl.

CPC ..... *B41J 2/14* (2013.01); *Y10T 29/49401* (2015.01); *B41J 2/1621* (2013.01); *B41J 2/14209* (2013.01); *B41J 2002/14225* (2013.01); *B41J 2202/07* (2013.01)

(58) Field of Classification Search

CPC ..... B41J 2/1606; B41J 2/1628; B41J 2/1632; B41J 2/1645; B41J 2/19; B41J 2/17593; B41J 2/1433; B41J 2/162

USPC ..... 347/20, 21, 45, 47, 92–94, 88, 54

See application file for complete search history.

(56) References Cited

U.S. PATENT DOCUMENTS

| | | | | |
|---|---|---|---|---|
| 6,502,924 | B1 * | 1/2003 | Muramatsu et al. | 347/54 |
| 6,969,165 | B2 | 11/2005 | Olsen | |
| 7,159,974 | B2 | 1/2007 | Gray et al. | |
| 2005/0168540 | A1 | 8/2005 | Wilson et al. | |
| 2006/0023038 | A1 | 2/2006 | Seu | |
| 2006/0044367 | A1 | 3/2006 | Campillo et al. | |
| 2006/0090645 | A1 | 5/2006 | Kent | |
| 2011/0157278 | A1 | 6/2011 | Gulvin et al. | |
| 2011/0279516 | A1 | 11/2011 | Hu et al. | |
| 2012/0044298 | A1 | 2/2012 | Sambhy et al. | |
| 2014/0071205 | A1 | 3/2014 | Platt et al. | |

OTHER PUBLICATIONS

Jan. 27, 2015, File History for U.S. Appl. No. 13/856,424.
Feb. 24, 2015, File History for U.S. Appl. No. 13/856,424.

* cited by examiner

*Primary Examiner* — Juanita D Jackson
(74) *Attorney, Agent, or Firm* — Hollingsworth Davis, LLC

(57) ABSTRACT

An inkjet printhead includes an oleophobic membrane arranged at a location that allows the oleophobic membrane to simultaneously vent air from an ink flow channel of the printhead and to retain ink within the ink flow channel. The oleophobic membrane includes a metal structure having a nanostructured surface and low-surface energy coating disposed on the metal structure.

21 Claims, 20 Drawing Sheets

INKJET PRINTHEAD INCORPORATING OLEOPHOBIC MEMBRANE

TECHNICAL FIELD

This application relates generally to air removal from inkjet printer subassemblies.

BACKGROUND

Inkjet printers are widely used and well known in the personal computer industry. Inkjet printers operate by ejecting small droplets of liquid ink onto print media in accordance with a predetermined computer generated pattern. Typically, inkjet printers utilize liquid or solid wax based inks that are instantly heated to a molten liquid state, forced through an inkjet printhead nozzle onto print media, and then allowed resolidify on the print media upon cooling.

SUMMARY

Some embodiments involve an inkjet printhead that includes an oleophobic membrane. The oleophobic membrane includes a metal structure having a nanostructured surface and a low-surface energy coating disposed upon the metal structure. In some embodiments the metal structure can include stainless steel and can have a plurality of pores. The nanostructured surface can include one or more of an etched surface, metal nanofibers, metal nanoparticles, or a coating of nanoparticles. The low-surface energy coating can include a substantially fluorinated material.

Some embodiments describe an aperture plate for an inkjet printhead. The aperture plate includes an oleophobic membrane comprising: a metal structure having a nanostructured surface and a low-surface energy coating disposed on the metal structure. A pattern of apertures extend through the oleophobic membrane, the pattern and diameter of the apertures is configured to allow ink jetting of a phase-change ink according to a print pattern.

Some embodiments are directed to a method of operating an inkjet printer. The method includes moving phase change ink through an ink flow channel in a printhead. Bubbles in the ink are vented out of the ink flow channel using an oleophobic membrane. The oleophobic membrane contains the ink within the ink flow channel.

Some embodiments involve a method of making an inkjet printhead. The method includes forming an oleophobic membrane and arranging the oleophobic membrane on the printhead at a location that allows air to vent through the oleophobic membrane while containing ink in the printhead. Forming the oleophobic membrane includes forming a nanostructured surface on a metal scaffold and coating the nanostructured surface with a low surface energy coating.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings, where like reference numerals designate like elements, and wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1:
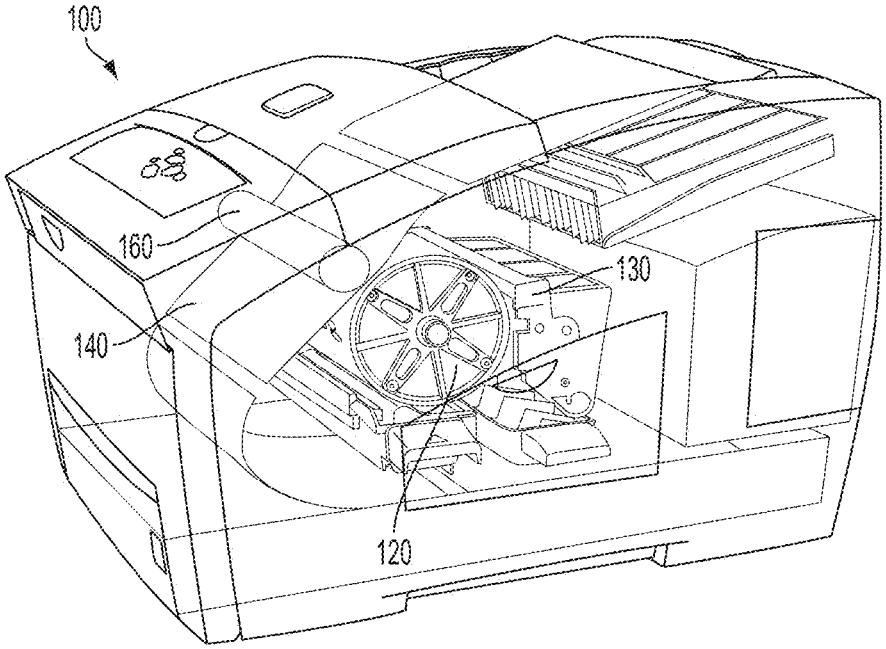
FIGS. 1 and 2 are perspective views of an inkjet printer.

In the following description, reference is made to the accompanying set of drawings that form a part of the description hereof and in which are shown by way of illustration several specific embodiments. It is to be understood that other embodiments are contemplated and may be made without departing from the scope of the present disclosure. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Inkjet printers operate by ejecting small droplets of liquid ink onto print media according to a predetermined computer-generated pattern. In some implementations, the ink can be ejected directly onto a final print media, such as paper. In some implementations, the ink can be ejected onto an intermediate print media, e.g. a print drum, and can then be transferred from the intermediate print media to the final print media. Some inkjet printers use cartridges of liquid ink to supply the ink jets. Some printers use phase-change ink which is solid at room temperature and can be melted just before being jetted onto the print media surface. Phase-change inks that are solid at room temperature advantageously allow the ink to be transported and loaded into the inkjet printer in solid form, without the need for packaging or cartridges typically used for liquid inks. In some implementations, the solid ink can be melted in a page-width printhead which can propel the molten ink in a page width pattern onto an intermediate drum. The pattern on the intermediate drum can be transferred onto paper through a pressure nip.

Wax based inks for inkjet printers go through freeze and thaw cycles that can trap air bubbles within the ink. In the liquid state, ink may contain air bubbles that can obstruct the passages of the ink jet pathways. For example, bubbles can form in solid ink printers due to the freeze-melt cycles of the ink that occur as the ink freezes when printer is powered down and melts when the printer is powered up for use. As the ink freezes to a solid, it contracts, forming voids in the ink that can be subsequently filled by air. When the solid ink melts prior to ink jetting, the air in the voids can become bubbles in the liquid ink. The trapped air bubbles may create inaccuracies such as incomplete or missing characters on the printing media if they are not removed. Air bubbles can be removed from liquid printing ink by purging the ink through the inkjet printhead nozzles. However, the purging process can result in end-user waste of ink and power.

Embodiments described in this disclosure involve bubble mitigation processes to reduce air bubbles in a liquid material, such as melted phase-change ink. Phase-change inks, when heated can be an oily liquid and the bubble mitigation processes described herein can utilize oleophobic membranes that selectively contain ink within ink flow channels of the inkjet printer while simultaneously allowing air to vent through the oleophobic membranes. Oleophobic materials are those that lack affinity for oils or waxes, and tend to repel oily substances. Typical locations for a bubble mitigation process may be within an inkjet printhead. In this disclosure, the inkjet printhead is construed to mean the actual part of the printhead that ejects ink as well as all other parts of the inkjet printer that handle the inkjet ink—molten or otherwise. This includes, for example, the ink-flow path within the inkjet printer, the molten ink reservoir, ports, and manifolds (such as finger manifolds).

Figure 2:
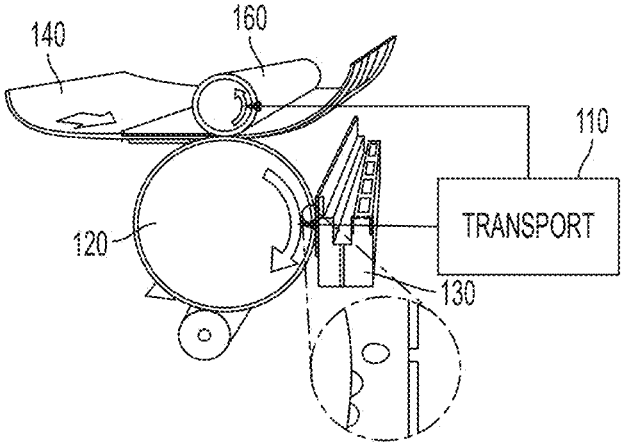

FIGS. 1 and 2 are perspective views of a typical inkjet printer Inkjet printer 100 includes transport mechanism 110 that is configured to move drum 120 relative to inkjet printhead 130 and to move paper 140 relative to drum 120 Inkjet printhead 130 may extend fully or partially along the length of drum 120 and includes a number of ink jets. As drum 120 is rotated by transport mechanism 110, ink jets of inkjet printhead 130 deposit droplets of ink though ink jet apertures onto drum 120 in the desired pattern. As paper 140 travels around drum 120, the pattern of ink on drum 120 is transferred to paper 140 through pressure nip 160.

Figure 3:
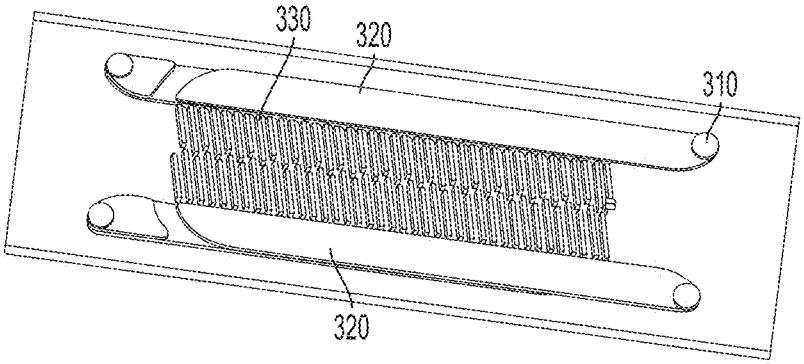
FIGS. 3 and 4 a top down and perspective view of portions of the detailed interior of the inkjet printer illustrated in FIGS. 1 and 2.
Figure 4:
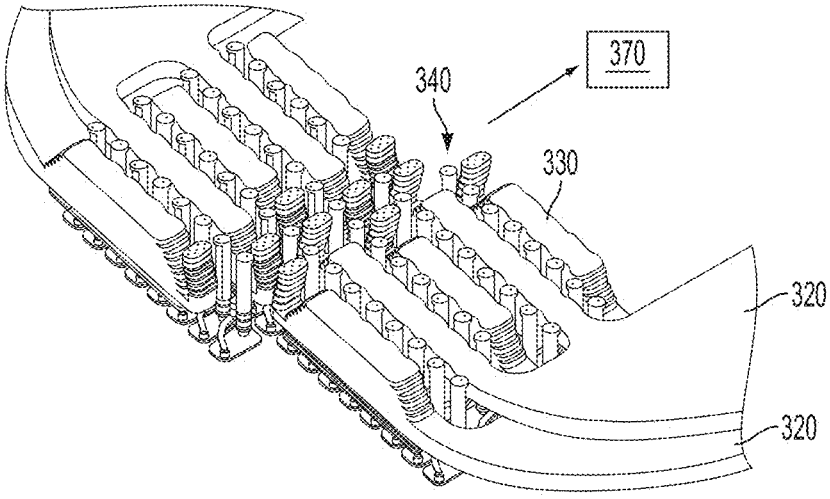

FIGS. 3 and 4 shows more detailed views of an exemplary inkjet printhead. The path of molten ink, contained initially in a reservoir, flows through port 310 into main manifold 320 of the inkjet printhead. As best seen in FIG. 4, in some cases, there are four main manifolds 320 which are overlaid, one manifold 320 per ink color, and each of these manifolds 320 connects to interwoven finger manifolds 330. The ink passes through the finger manifolds 330 and then into ink jets 340. The manifold and ink jet geometry illustrated in FIG. 4 is repeated in the direction of the arrow 370 to achieve a desired inkjet printhead length, e.g. the full width of the drum.

Figure 5:
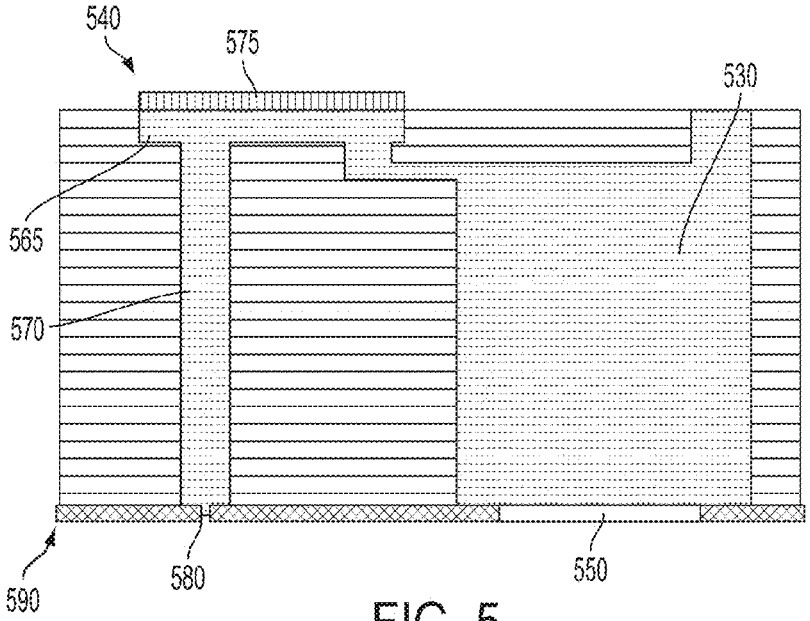
FIG. 5 provides a side view of a finger manifold and inkjet which shows a possible location for an oleophobic membrane according to some embodiments.

In some examples discussed in this disclosure, the inkjet printhead uses piezoelectric transducers (PZTs) for ink droplet ejection; although other methods of ink droplet ejection are known. FIG. 5 provides a more detailed view of a finger manifold 530 and ink jet 540. Activation of PZT 575 causes a pumping action that alternatively draws ink into ink jet body 565 from the manifold 530 and expels the ink through ink jet outlet 570 and out of aperture 580.

FIG. 5 shows a possible location for oleophobic membrane 550 in finger manifold 530. Oleophobic materials can be used to form semipermeable membranes that allow passage of air but block passage of oily liquids, such as phase-change ink. The oily ink forms can form a high contact angle with oleophobic materials. The semipermeable oleophobic membranes described herein can have small pores that allow air to pass through, but the high contact angle formed by the ink on the oleophobic material can prevent the ink from passing through the small pores of the oleophobic membrane. The integrity of the oleophobic membranes to block the passage of ink can be maintained under pressure for sufficiently high contact angle between the ink and the oleophobic material and sufficiently small pore size. The oleophobic membrane 550 may be located elsewhere in the printhead or elsewhere in the inkjet printer, such as the main manifold, for example. The inkjet printhead may include multiple particle removal devices some or all of which that include oleophobic membranes according to embodiments disclosed herein. Oleophobic membrane 550 allows air to vent out of the finger manifold while containing the ink within the finger manifold and allowing ink (substantially devoid of air bubbles) to flow into ink jet body 565.

Figure 6:
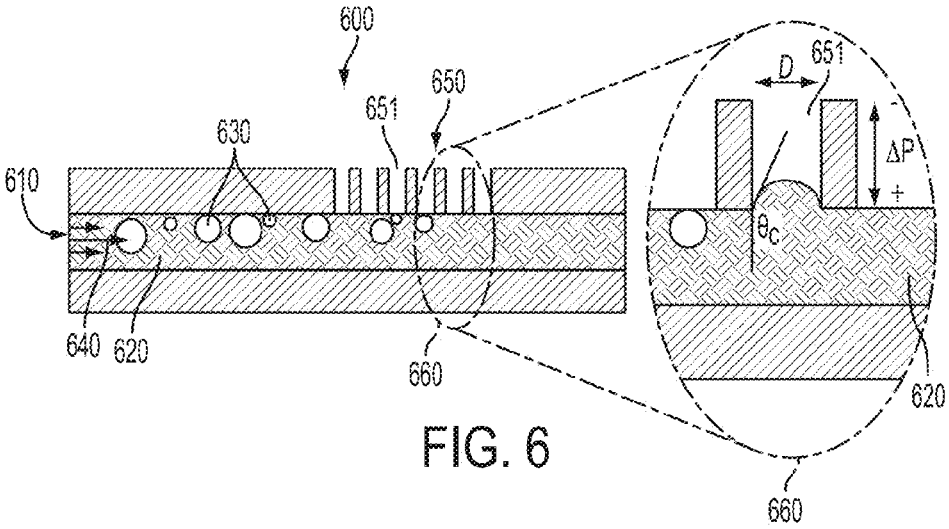
FIG. 6 is a side view of an oleophobic membrane.

FIG. 6 is a side cross sectional view of ink flow channel 600 that shows an example of oleophobic membrane 650 according to some embodiments. FIG. 6 shows ink passage 610 that contains ink 620 and bubbles of air 630 in a portion of passage 610 Ink 620 and air bubbles 630 flow through passage 610 along the direction indicated by arrow 640. Oleophobic membrane 650 is disposed along a portion of channel 600. Oleophobic membrane 650 includes pores 651. FIG. 6 shows an enlarged version of portion 660 and illustrates the contact angle of ink with the low-surface energy coating 652 of membrane 650. This close up view shows a side view of the ink flow channel 600 and pore 651 of oleophobic membrane 650. Pore 651 has a diameter D. Ink 620 forms a contact angle, $\theta_c$, with oleophobic membrane 650 at the location of pore 651. The surface of oleophobic membrane 650 provides a contact angle greater than 90 degrees with the liquid material, such as liquid phase change ink 620, when measured statically using a goniometer. In some cases, a suitable pore diameter for the oleophobic membrane is a diameter that prevents ink bleed out at pressures consistent with inkjet applications. For example, an average pore diameter of the oleophobic membrane being between about 0.1 and about 10 μm may confine the ink within the ink flow channel while simultaneously venting the bubbles.

Figure 7A:
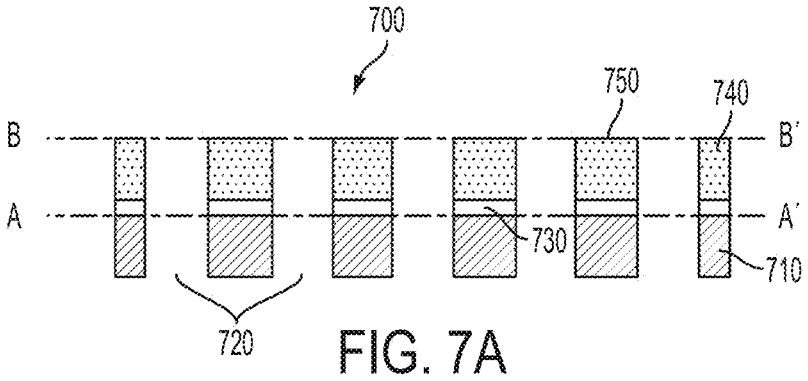
FIGS. 7A, 7B, and 7C are views of an oleophobic membrane according to embodiments described herein.

FIG. 7A shows a cross section of an oleophobic membrane 700 comprising metal structure 710. The metal structure optionally includes a surface 730 which may optionally be a nanostructured surface. A low surface energy coating 740 is disposed on the surface 730 of the metal structure 710. The low-surface energy coating 740 optionally may further comprise nanoparticles 750. The metal structure 710 includes pores 720 and the low surface energy coating coats the surface 730 of the metal structure and extends into the pores 720.

Figure 7B:
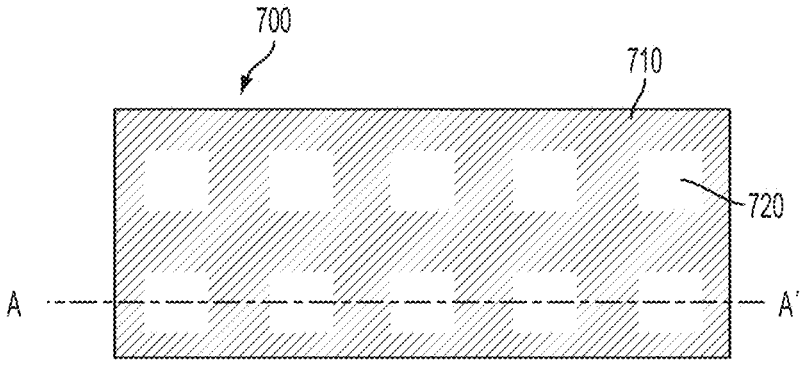

FIG. 7B is a view of a portion of the oleophobic membrane 700 showing a major surface of the metal structure 710 of the membrane 700 and illustrating the pores 720. The pores 720 of the metal structure 710 have an average diameter of about 0.1 μm and about 10 μm. Low-surface energy coating 740 should not substantially block pores 720 and should not substantially alter the structure of nanostructured surface 730. For example, substantial blockage of pores occurs when more than about 70% of the pore surface area is occluded by the coating 740. Alteration of the nanostructured surface 730 can occur if the coating 740 is too thick, and buries the surface nanostructures. For example, the coating 740 should be thinner than about 50% or even less than about 25% of the average height of the nanostructures on the surface 730.

Figure 7C:
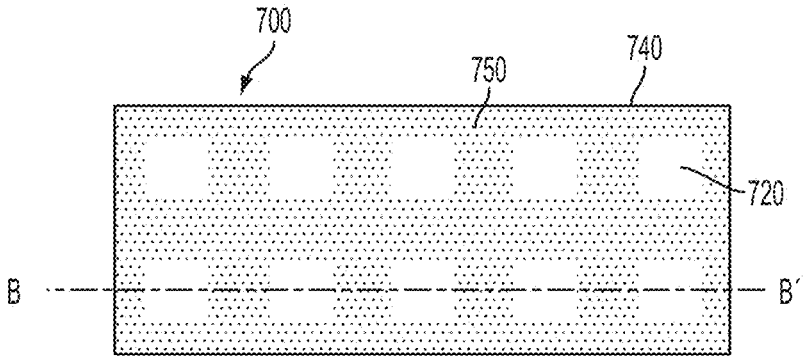

FIG. 7C is a view of a surface of the low surface energy coating 740. The low energy surface coating 740 optionally includes nanoparticles 750. The nanoparticles 750 also increase surface roughness that decrease the energy per unit area for the ink-surface interface such that a high ink contact angle is achieved for the oleophobic membrane 700. If nanoparticles 750 are used in the coating, the size of the nanoparticles may be about the same size as or smaller than the size of the nanostructured features of the metal surface 710. The nanoparticles and/or nanostructured features may have diameters of about 25 nm. In various embodiments, the nanoparticles and/or nanostructured feature sizes may have diameters in a range from about 1 nm to about 100 nm. In some embodiments, the major cross sectional diameter of the nanostructured particles 750 averages less than about 50% or less than about 25% or even less than about 10% of the average major cross sectional diameter of the nanostructured features of the surface 730 metal structure 710. Note that the term "nanostructured features" of the surface refers to the structural integrity of the surface.

The surface roughness of an example oleophobic surface described herein was measured as follows: Ra=1.79 μm, Rq=3.61 μm, Rz=60.44 μm, Rt=78.98 μm, where Ra=average roughness, Rq=root mean square (RMS) roughness, Rz=average of 10 greatest peak to valley separations, and Rt=peak to valley difference. A smooth silicon surface, by comparison, measured Ra=94.99 nm, Rq=114.57 nm, Rz=940.60 nm, and Rt=2.17 um. From this data, the above roughness parameters Ra, Rq, Rz, Rt may be 10 or more times greater for the oleophobic surface than for smooth silicon.

Figure 8A:
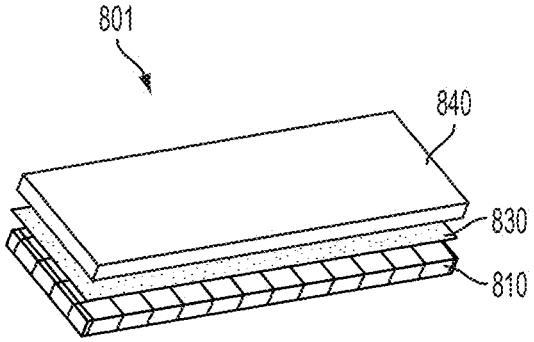
FIGS. 8A-D illustrate single sided and double sided coated oleophobic membranes in accordance with various embodiments.

FIGS. 8A-8D illustrate oleophobic membranes 801-804 according to various embodiments. FIG. 8A shows an oleophobic membrane 801 comprising scaffold-like structure 810. In many embodiments, the structure 810 is metal, but other materials (ceramics, plastics, glass) could be used. Typical structures comprise metal (e.g. aluminum, stainless steel, and/or titanium) having a coefficient of thermal expansion between about $8.6\times10^{-6}$ $C^{-1}$ and about $39.7\times10^{-6}$ $C^{-1}$. Exemplary structures 800 may include stainless steel and/or other metals and/or other materials with similar durability and thermal expansion. Oleophobic membranes can be somewhat fragile when used in inkjet printer applications. The use of a metal scaffold-like structure, such as a stainless steel scaffold-like structure for example, can provide mechanical strength that is sufficient to prevent substantial flexing and mechanical failure of the membrane during use. As previously discussed in conjunction with FIG. 7, a plurality of pores (not shown in FIGS. 8A-8D) extend through the oleophobic membranes 801-804.

Optionally, the surface 830 of metal structure 810 is nanostructured. The nanostructured surface texture can be imparted onto the metal scaffold-like structure 810 through various methods generally including etching, electrospinning, sintering of nano-textured metallic particles, sintering of metal nanoparticles or nanofibers, or a coating of metal nanoparticles.

Disposed on surface 830 is low-surface energy coating 840. Low-surface energy coating 840 is a conformal coating that conforms to and interacts with surface 830 to increase the oleophobicity of oleophobic membrane. The high ink contact angle generally ensures a substantially more ink-phobic oleophobic membrane 850 than the uncoated metal structure 810 alone. Low-surface energy coating 840 typically comprises a perfluorinated or a substantially fluorinated material. In this disclosure "substantially fluorinated" refers to hydrofluorocarbons wherein at least 75% of CH bonds are fluorinated. Typical low-surface energy coatings 840 may include, for example, $(C_2F_4)_n$ or $C_7HF_{13}O_5S.C_2F_4$ and may be deposited through a variety of means including dip-coating, sputtering, vapor deposition, or by similar methods of deposition.

Figure 8B:
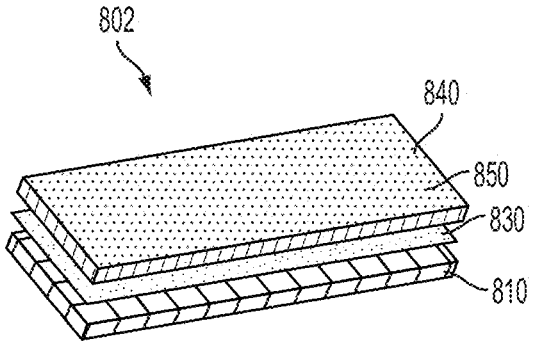

FIG. 8B illustrates an oleophobic membrane 802 that includes a low-surface energy coating 840 may generally comprise suspended, embedded, or coated nanoparticles 850, or a surface upon which nanoparticles 850 are disposed. Typical nanoparticles 850 may include oxides, borides and nitrides capable of withstanding the high temperatures necessary for melting the phase change ink. Typical melting temperatures of the phase change ink are about 80° C. to 130° C. For example, in one embodiment nanoparticles 850 may comprise $TiO_2$.

Figure 8C:
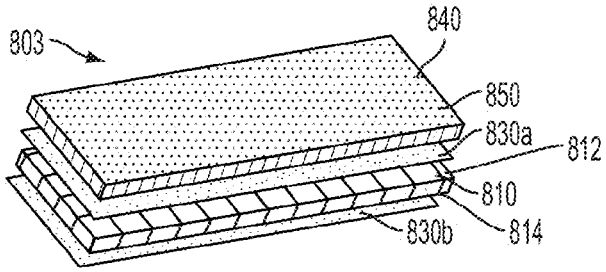
Figure 8D:
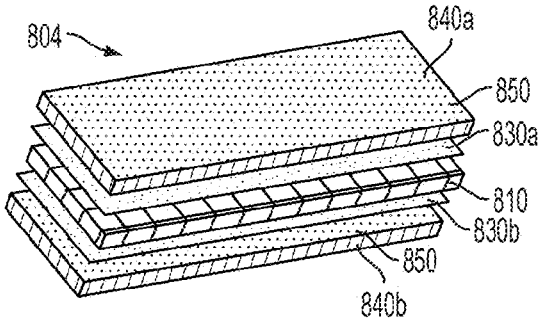

An oleophobic membrane 803 illustrated in FIG. 8C illustrates nanostructured surface 830*a* formed on a first major surface 812 of the metal structure 810 and nanostructured surface 830*b* formed on a second major surface 814 of the metal structure 810. Nanostructured surfaces 830*a*, 830*b* may be imparted onto first 812 and second 814 surfaces of metal structure 810 through various methods generally including etching, electrospinning, sintering of nano-textured metallic particles, or sintering of metal nanoparticles. Note that the characteristics, materials, and/or methods used to form the first nanostructured surface 830*a* may be different from or the same as the characteristics, materials, and/or methods used to form the second nanostructured surface 830*b*.

An oleophobic membrane 804*f* depicted in FIG. 8F may include low-surface energy coating 840*a* disposed on first nanostructured surface 830*a*, and second low surface energy coating 840*b* disposed on second nanostructured surface 830*b*. As previously discussed, low-surface energy coatings 840*a*, 840*b* may comprise a perfluorinated or a substantially fluorinated material, and may be deposited through a variety of means including dip-coating, sputtering, vapor deposition, or by similar methods of deposition. Note that the characteristics, materials, and/or methods used to form the first low surface energy coating 840*a* may be different from or the same as the characteristics, materials, and/or methods used to form the second low surface energy coating 830*b*. For example, the first low surface energy coating 840*a* may include a different amount of nanoparticles 850 than the second low surface energy coating 840*b*.

Figure 9:
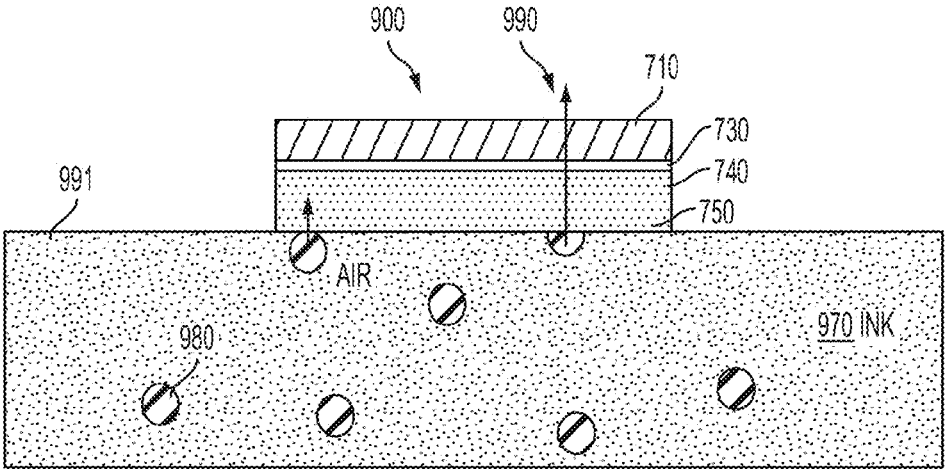
FIG. 9 illustrates the venting of air bubbles through an oleophobic membrane disposed on an inkjet printhead to contain ink within an ink flow channel and to vent air through the oleophobic membrane.

FIG. 9 shows an illustration of placement of an oleophobic membrane 900 according to one embodiment. Membrane 900 is configured to allow venting of air bubbles 980 through liquid phase change ink 970 in the direction of arrow 990. As previously discussed, the oleophobic membrane assemblies described herein can be disposed in a variety of locations along the ink flow path 991 of an inkjet printer. For example, in some cases, the oleophobic membranes discussed herein may be used to form a portion or all of an aperture plate for the ink jet printer. Referring back to FIG. 5, the aperture plate 590 includes apertures having an average diameter between about 20 μm and about 30 μm suitable to allow ink to be jetted by the PZT or other transducer onto the print media. In some cases, all or a substantial portion (e.g., greater than 50% of the surface area) of aperture plate may be oleophobic membrane 550.

Figure 10A:
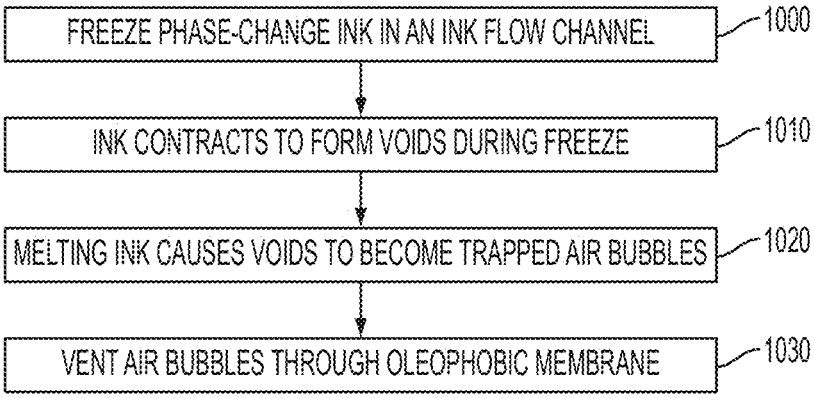
FIGS. 10A and 10B are flow diagrams illustrating processes of using an oleophobic membrane to vent air from an inkjet printer ink flow channel.

FIG. 10A is a flow diagram illustrating the method of operating an inkjet printer for venting air through the oleophobic membrane according to some embodiments Ink is frozen inside an ink flow channel 1000. At step 1010, voids form in the ink as the ink contracts during freezing. As the ink is melted in step 1020 the voids become trapped air bubbles. Using the oleophobic membrane of step 1030 allows the air bubbles to pass through the membrane to be vented, but concurrently prevents the ink from passing through as ink moves through the ink flow channel.

Figure 10B:
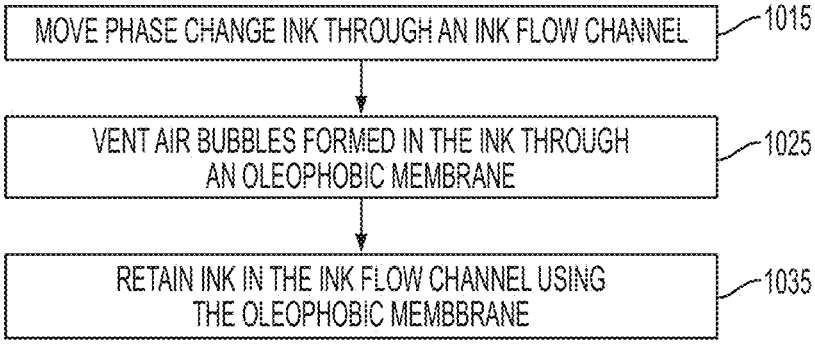

In another aspect, a method of operating an inkjet printer is shown and is illustrated diagrammatically in FIG. 10B. The method includes moving 1015 phase change ink through an ink flow channel in an inkjet printhead. Air bubbles present in the ink are vented 1025 out of the ink flow channel through an oleophobic membrane while the ink is retained 1035 within the ink flow channel by the oleophobic membrane. The oleophobic membrane includes a metal structure having a nanostructured surface and a low-surface energy coating disposed upon the metal surface. Additional details and embodiments of the oleophobic membrane are disclosed in the description above.

Figure 11:
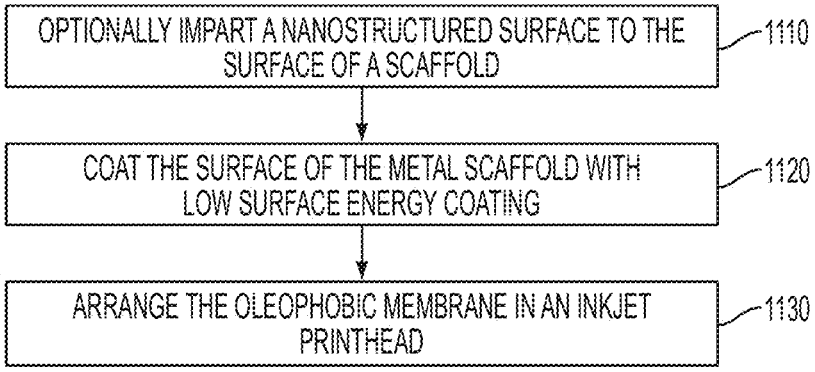
FIG. 11 is a flow diagram illustrating a process of making an inkjet printhead having an oleophobic membrane according to embodiments discussed herein.

FIG. 11 is a flow diagram illustrating a process of making an inkjet printer printhead that includes an oleophobic membrane. The oleophobic membrane is formed coating 1120 a surface of a scaffold that includes pores with a low surface energy coating. The low surface energy coating is configured to provide a contact angle with ink greater than 90 degrees. Prior to coating the surface with the low surface energy coating, a nanostructured surface may be imparted 1110 to the surface of the scaffold. The oleophobic membrane is arranged 1130 in the inkjet printhead in a location that allows venting of bubbles from an ink flow channel of the inkjet printhead through the oleophobic membrane while retaining ink in the ink flow channel.

The scaffold may comprise metal, plastics, ceramics, glass, or other suitable materials. The nanostructured surface, if used, may be imparted by on the surface of the scaffold by surface etching, by electospinning nanofibers and/or nanoparticles, and/or by coating nanoparticles/fibers onto the surface of the scaffold. For example, in some arrangements, metal oxide nanoparticles and/or nanofibers are laid down on the surface in an appropriate organic matrix. The metal oxide nanoparticles/fibers are then sintered to leave metal nanoparticles/fibers behind on the surface. In some embodiments, the nanostructured texture can be imparted to the surface by coating the surface with a coating having suspended, embedded nanoparticles/nanofibers. Any combination of techniques may be used to impart the nanostructured surface to the scaffold.

The coating can be deposited on the scaffold by various processes, including dip-coating, sputtering, or vapor deposition. The nano-features of the surface texture and/or coating provide the low energy surface that provides oleophobicity.

Figure 12:
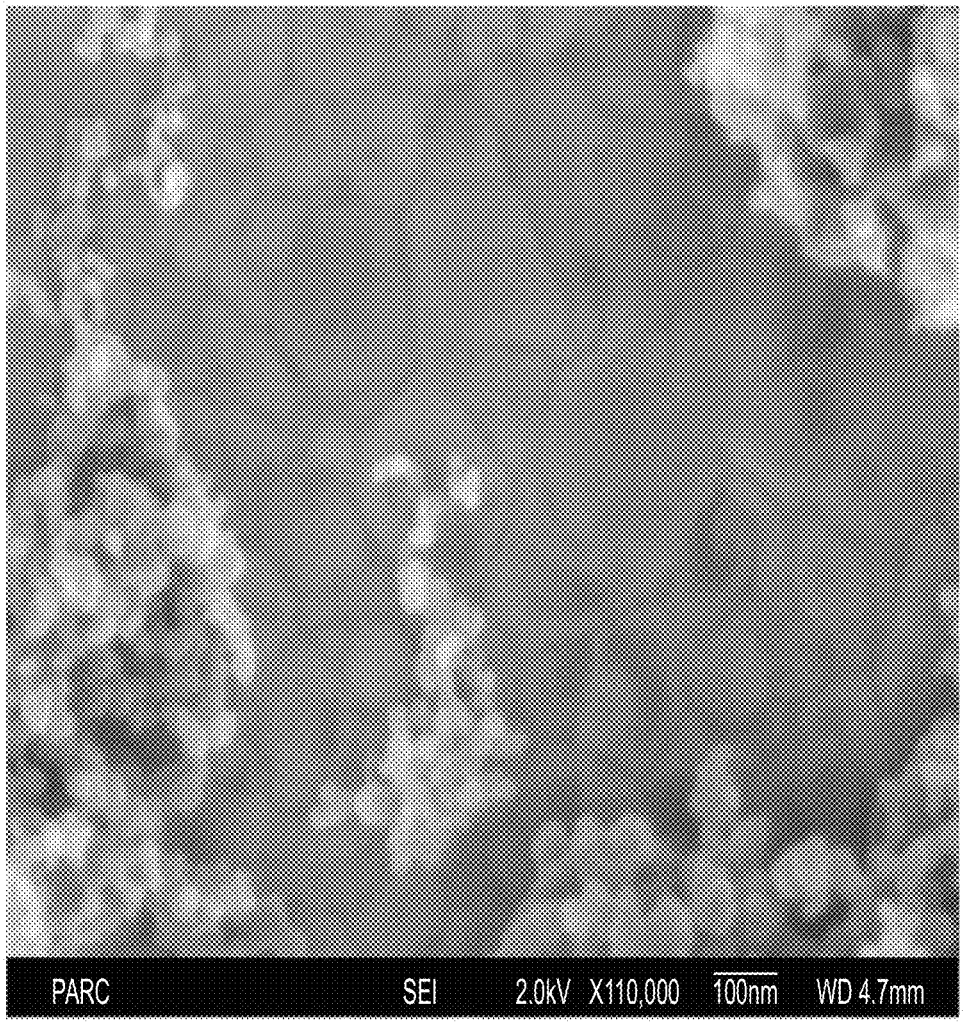
FIG. 12 is an image of Titania nanoparticles available from Evonik Industries disposed on an Au substrate, representing nanoparticles that may be used to create the surface texture of the scaffold according to processes discussed herein.
Figure 13A:
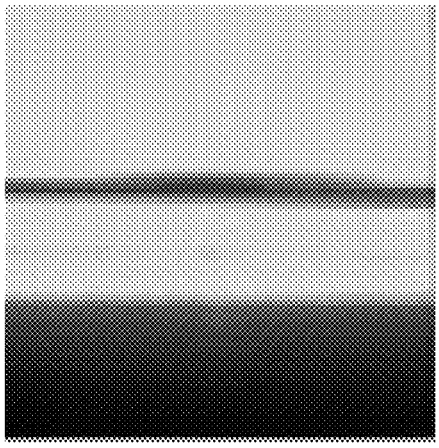
FIGS. 13A, 13B, 14A, 14B, 15A, 15B, 16A, 16B, 17A, and 17B show the results of depositing 11 mg (+/−1 mg) of melted ink on various uncoated stainless steel structures and then allowing the ink to freeze.
Figure 13B:
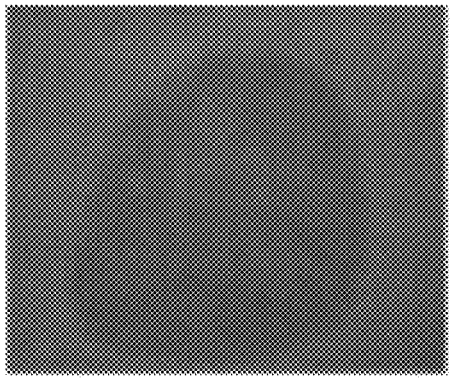
Figure 14A:
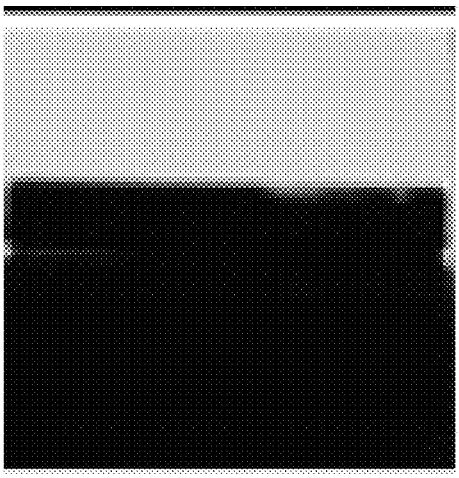
Figure 14B:
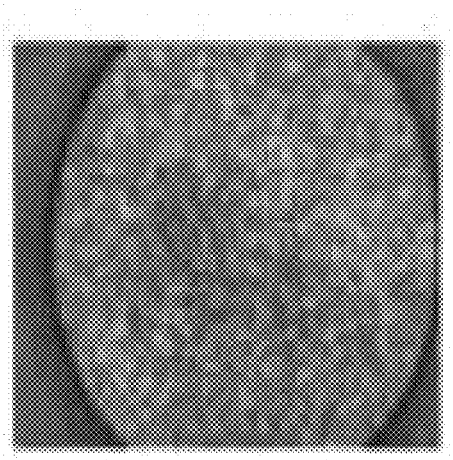
Figure 15A:
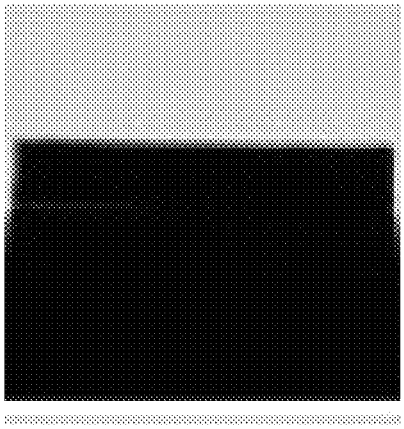
Figure 15B:
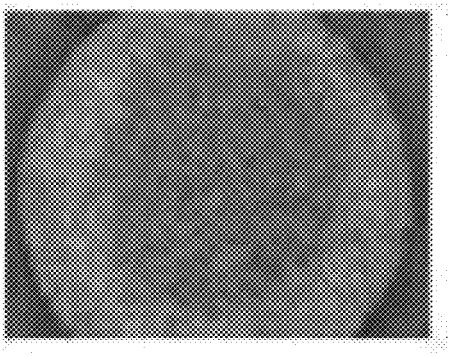
Figure 16A:
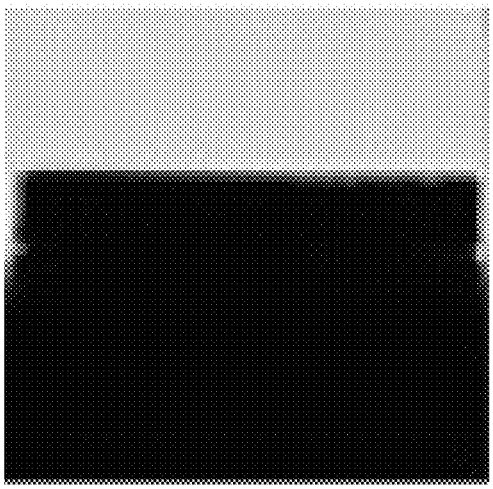
Figure 16B:
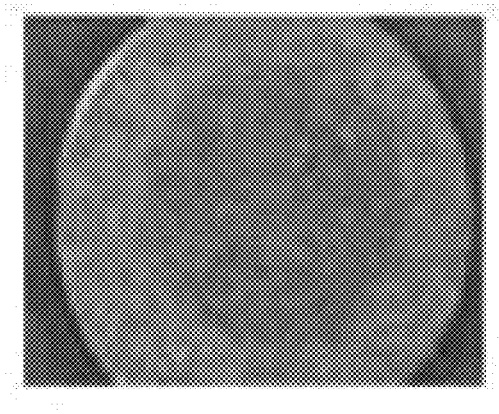
Figure 17A:
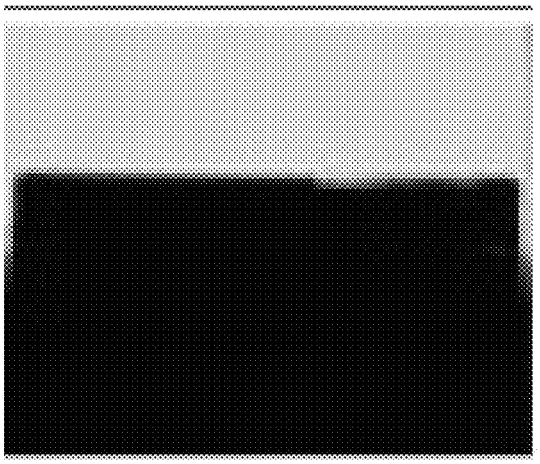
Figure 17B:
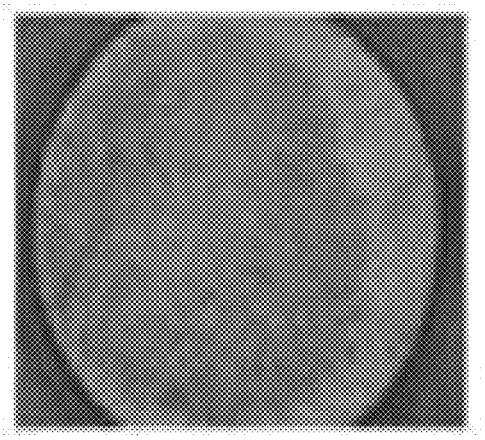

FIG. 12 is an image of Titania nanoparticles available from Evonik Industries disposed on an Au substrate, representing nanoparticles that may be used to create the surface texture of the scaffold according to processes discussed above.

FIGS. 13 through 17 show the results of depositing 11 mg (+/−1 mg) of melted ink on various uncoated stainless steel structures and then allowing the ink to freeze. FIGS. 13A-17A are side views and FIGS. 13B-17B are top views of the uncoated stainless steel structures after deposition and freezing of the ink. FIGS. 13A and 13B, respectively, show the results of depositing ink onto a 2 μm pore rated Dutch twill weave stainless steel substrate available from TWP. FIGS. 14A and 14B, respectively, show the results of depositing ink onto sintered stainless steel Type 316 media grade 10 available from Mott. FIGS. 15A and 15B, respectively, show the results of depositing ink onto sintered stainless steel Type 316 media grade 5 available from Mott. FIGS. 16A and 16B, respectively, show the results of depositing ink onto sintered stainless steel Type 316 media grade 2 available from Mott. FIGS. 17A and 17B, respectively, show the results of depositing ink onto sintered stainless steel Type 316 media grade 0.5 available from Mott. In each of the examples illustrated in FIGS. 13-17, the ink spread across the surface of the stainless steel substrate and soaked into the substrate indicating insufficient oleophobicity to contain ink.

Figure 18A:
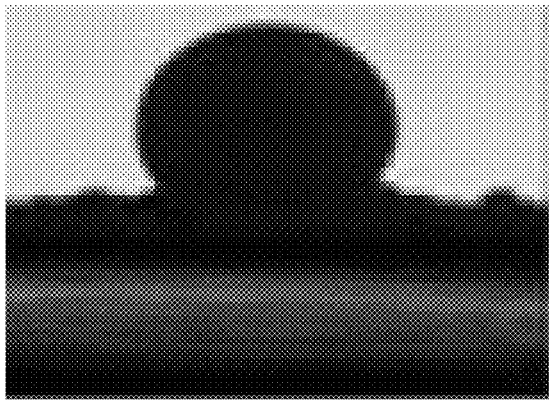
FIGS. 18A, 18B, 19A, and 19B show the results of depositing and then allowing to freeze 11 mg (+/−1 mg) of ink on stainless steel substrates coated with TEFLON AF 2400 with 3.3 wt % $TiO_2$ nanoparticles.
Figure 18B:
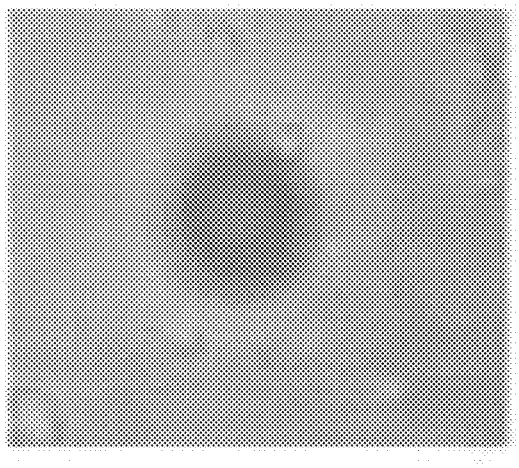
Figure 19A:
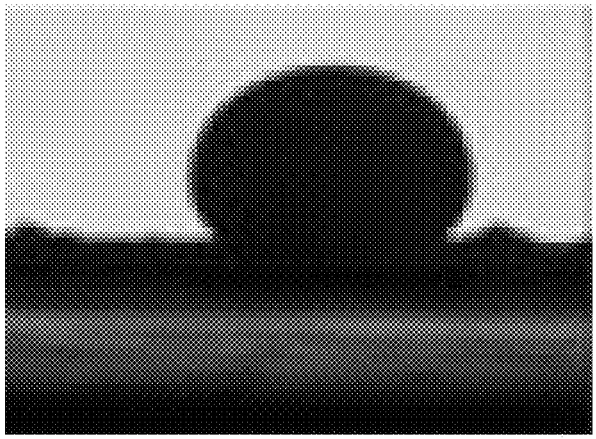
Figure 19B:
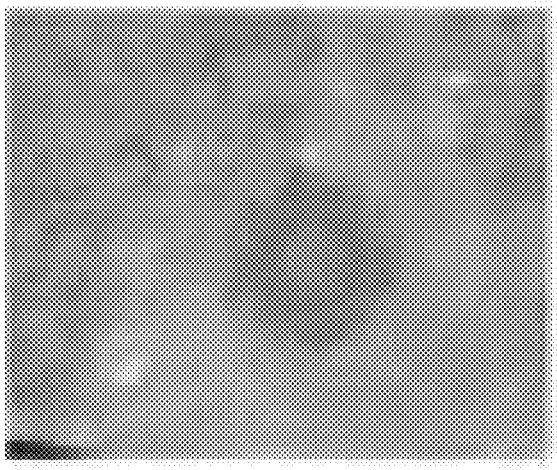

FIGS. 18-19 show the results of depositing and then allowing to freeze 11 mg (+/−1 mg) of ink on stainless steel substrates coated with TEFLON AF 2400 with 3.3 wt % $TiO_2$ nanoparticles. FIGS. 18A and 19A show side views of the coated stainless steel structures after deposition and freezing of the ink. FIGS. 18B and 19B show top views of the stainless steel structures after deposition and freezing 11 of the ink. FIGS. 18A and 18B, respectively, show the results of depositing and freezing ink onto 10 μm pore 304 stainless steel felt coated with 3.3% $TiO_2$P25 particles in 1% TEFLON AF2400 solution. FIGS. 19A and 19B, respectively, show the results of depositing and freezing ink onto 2 μm pore Dutch Twill Weave stainless steel mesh coated with 3.3% $TiO_2$P25 particles in 1% TEFLON AF2400 solution. In each case illustrated in FIGS. 18-19, the beaded shape of the ink, particularly evident in FIGS. 18A and 19A against the substrate illustrates a high ink contact angle with the oleophobic membrane.

Figure 20A:
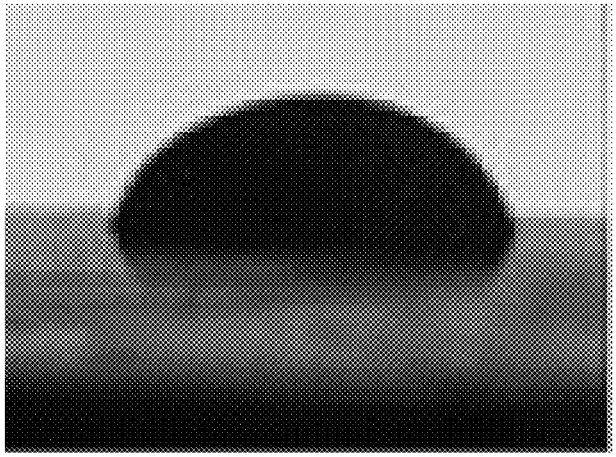
FIGS. 20A and 20B show side and top views, respectively, of 11 mg (+/−1 mg) of ink melted, then frozen on TEFLON 1600 coated on glass.
Figure 20B:
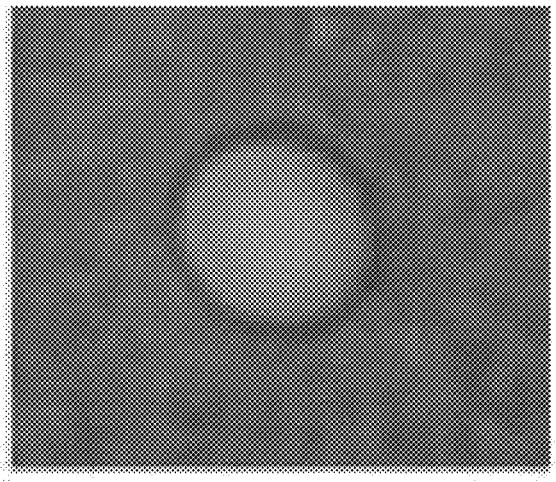
Figure 21A:
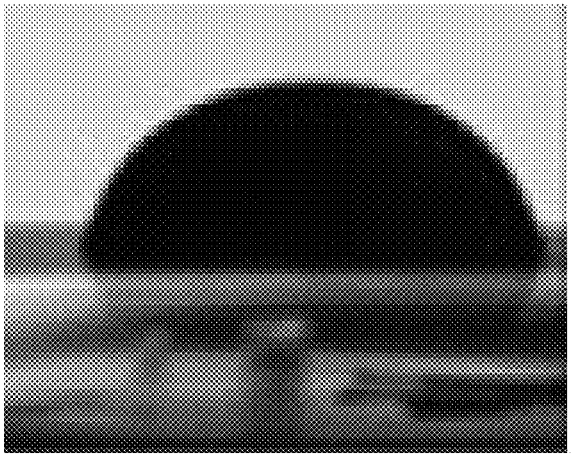
FIGS. 21A and 21B show side and top views, respectively, of 11 mg (+/−1 mg) of ink melted, then frozen on TEFLON 2400 coated on glass. In each case, the contact angle of the ink with the TEFLON coated glass is less than 90 degrees.
Figure 21B:
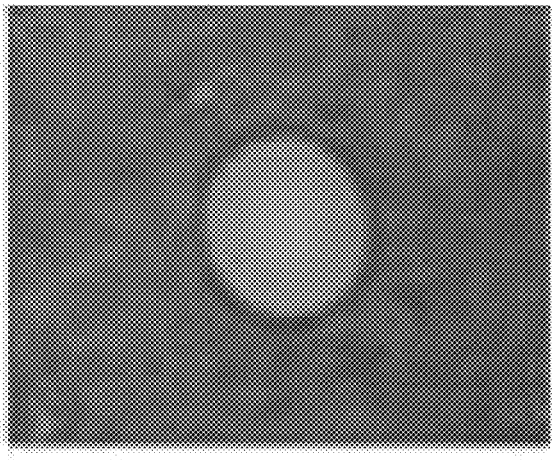

FIGS. 20A and 20B show side and top views, respectively, of 11 mg (+/−1 mg) of ink melted, then frozen on TEFLON 1600 coated on glass. FIGS. 21A and 21B show side and top views, respectively, of 11 mg (+/−1 mg) of ink melted, then frozen on TEFLON 2400 coated on glass. In each case, the contact angle of the ink with the TEFLON coated glass is less than 90 degrees.

Figure 22:
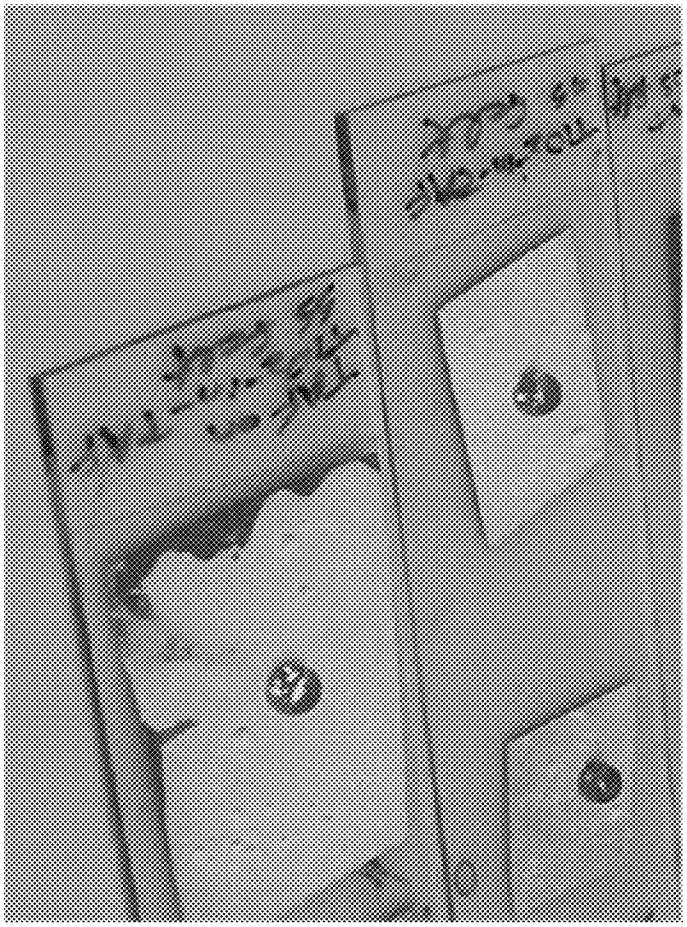
FIG. 22 is a photograph of three examples of 11 mg (+/−1 mg) of ink melted, then frozen on stainless steel felt coated with TEFLON 2400 with 3.3% $TiO_2$ P25 particles.

In contrast, FIG. 22 is a photograph of three examples of 11 mg (+/−1 mg) of ink melted, then frozen on stainless steel felt coated with TEFLON 2400 with 3.3% $TiO_2$ P25 particles. In each sample, the ink beads up on the surface, exhibiting a contact angle with the surface greater than 90 degrees.

It is well-documented in solid ink jet printers that bubbles form readily in the melted ink upon thawing, and that their removal, as currently practiced, is a purging of the ink through the print nozzles. This practice requires the end-user to sacrifice a significant quantity of ink supply for every room temperature-to-jet temperature thaw cycle, and, therefore, discourages power savings associated with turning off the printer completely.

Embodiments disclosed herein are directed to a class of membranes that are "oleophobic," or more specifically, form a contact angle higher than 90 degrees with inks, particularly melted polyethylene-based wax blends. As discussed above, some implementations employ the use of a construction metal e.g. stainless steel scaffold with pore sizes of about 0.1 to 10 um and a nanostructured texture, and the coating of such a surface with a low surface energy material e.g. a perfluorinated material in the form of TEFLON or Nafion. Various embodiments of the oleophobic membrane enable the venting of bubbles formed during the thaw process of wax-based ink while retaining the ink securely within the printhead, thereby reducing or eliminating the need for bubble-related ink purges.

Stainless steel, as it is the basis of printhead construction, has suitable thermal expansion and durability characteristics as the membrane substrate (scaffold), although other metals are applicable as well. A high-roughness nanostructure can be imparted through surface etching, electrospinning (by which nanofibers of the metal oxide in an appropriate organic matrix are laid down and then sintered to leave relatively pure metal nanofibers behind), sintering of nano-textured metallic particles, sintering of metal nanoparticles, or introduced as part of the coating as suspended/embedded nanoparticles (See, FIG. 12, for example, showing $TiO_2$ nanoparticles) or some combination of the above.

The nano-features serve to lower the surface-ink energy of interaction enough for a high ink contact-angle.

The coating, which may be deposited through dip-coating, sputtering, vapor deposition, etc., provides a much more ink-phobic surface than uncoated steel (see, e.g., comparative examples of FIGS. 13-19). One example of such a coating includes TEFLON AF 2400 with a 3.3 wt % loading of P25 Degussa $TiO_2$ nanoparticles (see, e.g., FIGS. 19, 20 and 23). The coating disclosed herein is much more ink-phobic than TEFLON alone (see, e.g., FIGS. 21-22).

Care must be taken during deposition of the coating to maintain the nanostructure of the surface so that the nano-features are not buried under a thick blanket layer and thereby obliterated, and to enable sufficient porosity in the membrane for bubble venting. It is understood that a robust embodiment would be a design balance between pore size, oleophobicity, venting pressure, mechanical durability under cyclic thermal conditions over a period of time.

Additionally, the oleophobic membranes disclosed herein can double as an aperture plate add-on. Standard stainless steel aperture plates are coated with an antiwetting fluorocarbon film which helps with ink dewetting and meniscus pinning Having enhanced antiwetting coatings will facilitate the printhead jetting and maintenance reliability. By using the processes disclosed herein, the oleophobic membrane (or components thereof) can be disposed on both sides of the aperture plate. Thus, the oleophobic membrane discussed herein can be used both as a breather membrane on the ink chamber side and a coated aperture plate on the outside surface. Thus, the oleophobic membrane coatings discussed herein can provide enhanced properties compared to current inkjet printhead manufacturing processes.

Particular materials and amounts thereof recited in the disclosed examples, as well as other conditions and details, should not be construed to unduly limit this disclosure.

What is claimed is:

1. An inkjet printhead, comprising:
an oleophobic membrane comprising:
a metal structure having a nanostructured surface; and
a low-surface energy coating disposed on the metal structure.

2. The inkjet printhead of claim 1, wherein the metal structure comprises stainless steel.

3. The inkjet printhead of claim 1, wherein the metal structure comprises a metal having a coefficient of thermal expansion between about $8.6\times10^{-6}$ $C^{-1}$ and about $39.7\times10^{-6}$ $C^{-1}$.

4. The inkjet printhead of claim 1, wherein the metal structure has a plurality of pores having an average pore diameter of between about 0.1 μm and about 10 μm.

5. The inkjet printhead of claim 1, wherein the nanostructured surface comprises at least one of an etched surface, metal nanofibers, metal nanoparticles, and a coating of nanoparticles.

6. The inkjet printhead of claim 1, wherein the low-surface energy coating comprises a substantially fluorinated material.

7. The inkjet printhead of claim 6, wherein the substantially fluorinated material comprises $(C_2F_4)_n$ or $C_7HF_{13}O_5S.C_2F_4$.

8. The inkjet printhead of claim 6, wherein the substantially fluorinated material comprises nanoparticles.

9. The inkjet printhead of claim 8, wherein the nanoparticles comprise oxides, borides, or nitrides.

10. The inkjet printhead of claim 9, wherein the nanoparticles comprise $TiO_2$.

11. The inkjet printhead of claim 1, wherein:
the metal structure comprises pores; and
the low-surface energy coating does not substantially block the pores and does not substantially change the structure of the nanostructured surface.

12. The inkjet printhead of claim 1, wherein:
the low-surface energy coating has a contact angle greater than 90 degrees with a liquid material; and
the liquid material comprises a melted phase-change ink.

13. The inkjet printhead of claim 1, wherein the oleophobic membrane is configured to vent air from a flow channel of the printhead.

14. An aperture plate for an inkjet printhead, the aperture plate comprising:
an oleophobic membrane comprising:
a metal structure having a nanostructured surface; and
a low-surface energy coating disposed on the metal structure; and
a pattern of aperture holes in the oleophobic membrane, the pattern and diameter of the apertures configured to allow ink jetting of a phase-change ink according to a print pattern.

15. The aperture plate of claim 14, wherein:
the oleophobic membrane includes pores having an average membrane pore diameter between about 1 μm and about 10 μm; and
the aperture holes have an average diameter of an average between about 20 μm and 30 μm.

16. The aperture plate of claim 14, wherein the nanostructured surface and low-surface energy coating is comprises a first nanostructured surface and first low-surface energy coating disposed on an ink flow channel side of the apertures plate and a second nanostructured surface and second low-surface energy coating are disposed on an outside surface of the aperture plate.

17. A method of operating an inkjet printer comprising:
moving phase-change ink through an ink flow channel in an inkjet printhead; and
venting bubbles formed in the phase-change ink during a phase change using an oleophobic membrane, wherein the oleophobic membrane comprises:
a metal structure having a nanostructured surface; and
a low-surface energy coating disposed upon the metal structure.

18. An oleophobic membrane comprising:
a metal structure having a nanostructured surface; and a low-surface energy coating disposed on the metal structure.

19. A method of making an inkjet printer printhead, comprising:

forming an oleophobic membrane, comprising:

forming a nanostructured surface on a metal scaffold; and coating the nanostructured surface with a low surface energy coating; and arranging the oleophobic membrane on the printhead at a location that allows air to vent through the oleophobic membrane while containing ink in the printhead.

20. The method of claim 19, wherein forming the nanostructured surface comprises one or more of:

etching a surface of the metal scaffold;

electrospinning nanoparticles onto the metal scaffold; and coating the nanoparticles onto the metal scaffold.

21. The method of claim 19, wherein coating the nanostructured surface comprises one or more of dip coating the low surface energy material onto the nanostructured surface;

sputtering the low surface energy material onto the nanostructured surface; and vapor depositing the low surface energy material onto the nanostructured surface.

* * * * *